US005867630A

United States Patent [19]

Kreuter et al.

[11] Patent Number: 5,867,630

[45] Date of Patent: Feb. 2, 1999

[54] INFRARED RADIATOR AND ITS MANUFACTURING PROCESS

[75] Inventors: Werner Kreuter, Hanau; Frank Brehm, Karlstein, both of Germany

[73] Assignee: Heraeus Noblelight GmbH, Hanau, Germany

[21] Appl. No.: 868,140

[22] Filed: Jun. 3, 1997

[30] Foreign Application Priority Data

Jun. 5, 1996 [DE] Germany ..... 196 22 466.7

[51] Int. Cl.[6] ..... A45D 20/40; H05B 3/10; H01C 1/024

[52] U.S. Cl. ..... 392/407; 219/553; 338/237

[58] Field of Search ..... 392/407, 411, 392/424, 422, 423; 338/295, 299, 304; 362/211, 217, 225, 227; 29/592.1; 219/541; 16/267, 268, 269; 24/8, 369, 370

[56] References Cited

U.S. PATENT DOCUMENTS 5,091,632 2/1992 Hennecke et al. ..... 219/553

FOREIGN PATENT DOCUMENTS 8913683 2/1990 Germany .
9113022 2/1992 Germany .
9115621 4/1992 Germany .

*Primary Examiner*—Teresa J. Walberg
*Assistant Examiner*—Vinod D. Patel
*Attorney, Agent, or Firm*—Oblon, Spivak, McClelland, Maier & Neustadt, P.C.

[57] ABSTRACT

An infrared radiator has a twin tube with an inner bridge that separates two housings which run along the longitudinal direction of the tube. A first heating spiral arranged in a first one of the housings is provided with an external electrical current supply and has a first end connected to a connection wire or a second heating spiral arranged in the second housing. A bore is formed in the inner bridge adjacent a second end of the first heating spiral and through which a connection body can extend from one housing into the other housing. The first heating spiral is thereby electrically connected to the connection wire or the second heating spiral. At least the first heating spiral is mounted under pull tension in the housing. Furthermore, for simplifying the mounting of the heating spiral of the infrared radiator, the bore is formed by boring through the jacket of the twin tube and the inner bridge. The connection body is then inserted into the through bore and the inner bridge, and is electrically connected to the first heating spiral and to the connection wire or to the second heating spiral. The bore is then closed off.

5 Claims, 3 Drawing Sheets

INFRARED RADIATOR AND ITS MANUFACTURING PROCESS

BACKGROUND OF THE INVENTION

1. Field of the Invention

The invention concerns a twin-tube infrared radiator with an inner bridge that separates two housings which run in a longitudinal direction along the tube. The invention further concerns a process for manufacturing the infrared radiator.

2. Description of the Related Art

An infrared radiator is described in German utility model application DE-U1 9,113,002, in which the lamp tube is shaped as twin tubes made of quartz glass and separated by an intermediate bridge. The twin tubes extend over a length of two equal radiator sections. Each of the housings of the twin tube consists of two housing halves. A heating spiral is arranged in each one of the four housing halves.

The heating spirals of each radiator section are arranged in a series by pairs. Each heating spiral is provided with a connection wire for the electrical current supply at its first end. The electrical connections for each heating spiral pair are guided out of the twin tubes at each of the front sides of the twin tubes by means of a vacuum-sealed area crimped between two welded molybdenum sheets.

The heating spirals of each of the heating spiral pairs are interconnected via an M-shaped bent molybdenum wire. The molybdenum wire grips an end of the heating spiral and is guided back by means of a first U-shaped bend within the housing, parallel to the heating spiral up to the first end. The inner bridge is bored out or milled out over a length of some centimeters in the area of the first end of the twin tube. Between the upper edge of the crimped area and the floor of the bridge bore is a cut a few centimeters wide. The molybdenum wire extends through this cut over a second U-shaped bend into the other housing where it is connected to the second heating spiral. Viewed in both housings, the molybdenum wire is M-shaped, and a level plane runs into the inner bridge. The molybdenum wire is coated with a quartz glass capillary tube in the area of the heating spiral to avoid short circuits. The heating spirals are held centered over a length within the housing by regularly distributed gap holders.

The manufacture of the known infrared radiator is very time consuming and requires great skill. Special asymmetric gap holders are necessary so that the heating spiral is always arranged centrally within the housing, despite the molybdenum wire that runs back parallel to the heating spiral.

The heating spiral is guided with great force into the twin tube in the known infrared radiators, while the gap holders press onto the inner walls of each housing. Therefore, a strong mechanical tension is applied to the heating spiral. After a few months, it is no longer tension-free. Thus, it runs the risk of creasing during operation. Therefore, the length of the heated zone is modified. This leads to breakdowns in the known infrared radiators.

During heating of the tungsten heating spiral while in operation, the material of the spiral recrystallizes. This changes the spiral measurements. In the known infrared radiators, it is therefore necessary to recrystallize the heating spiral before mounting. However, this makes the heating spiral rough, making installation in the twin tubes even more difficult. Furthermore, the recrystallization of the heating spiral requires a lot of time and great cost.

A twin tube radiator is also known from German utility model DE-U1 9,115,621, wherein both heating spirals are interconnected via a molybdenum handle, and wherein the molybdenum handle grips each front side end of the heating spiral. For facilitating the mounting of the molybdenum handle, it is proposed to remove the inner bridge of the twin tube by milling or boring a slit into the front side. The molybdenum handle is laid into the slit formed in this manner and then the front side of the twin tube is crimped. The known process permits the processing of the twin tube and the mounting of the molybdenum handle from the open side. The molybdenum handle is easily contorted to facilitate its insertion from the open front side. This leads, however, to position modifications of the heating spirals during the insertion of the radiator.

A further short-wave infrared radiator in the form of a twin tube is described in German utility model DE-U1 8,913,683, in which an infrared radiator of double length is created by welding together two individual radiators at their ends, whereby the individual radiators are connected independently of each other and are separated by a separator wall. The connection of the heating spirals takes place in each individual radiator by means of the handle mounted in the same way as the molybdenum handle in DE-U1 9,115,621.

SUMMARY OF THE INVENTION

It is an object of the invention to provide an operationally-safe infrared radiator.

It is a further object of the invention to provide a process for manufacturing a radiator that facilitates the mounting of the heating spiral.

The above objects are achieved according to the invention in that the inner bridge around a second end of the heating spiral has a through bore with a connection body that extends from one housing into the other. Thus, the first heating spiral is electrically connected to a connection wire or to the second heating spiral, wherein at least the first heating spiral is mounted under pull tension in the housing.

Independent of its manufacture, any kind of opening of the inner bridge is considered the through bore of the inner bridge in the area of the second end of the heating spiral, or seen from the direction of the longitudinal axis of the twin tube, it can be created in this area through a side opening from the outside to the inside of the twin tube.

The connection body that extends through the through bore is electrically connected to the second end of the heating spiral. The heating spiral can mount directly onto the connection body. One or more connection pieces can instead be provided between the connection body and the end of the heating spiral.

The connection body interconnects by the second ends of the first heating spiral and the second heating spiral being arranged in the neighboring housing or a connection wire being electrically arranged there. Both variations are designated as "connections" to the connection body, although only the embodiment with the "heating spiral pair" is explained for the sake of simplicity. The embodiments describe the variations of the heating spiral connection to the connection wire as well as the corresponding process for manufacturing the infrared radiator.

Since the connection body is arranged in the area of the second heating spiral ends, there is no need for a return line like in the conventional infrared radiator. In the infrared radiator of the invention, each second end of the heating spiral or the heating spiral itself and the connection wire must be connected to the connection body in such a manner that a firm electrical connection is created. The connection body can be installed in the through bore in a particularly simple manner through an opening in the side wall of the twin tube. For this purpose, it is not necessary to cut the twin tube, insert the connection body, and then weld the same again, and bore or mill the inner bridge before producing a crimped area. The mounting of the heating spiral is considerably facilitated in this manner and the twin tube does not show a surrounding seam.

The second end of the heating spiral can be geometrically fixed by means of a connection to the connection body. A change in the length of the heating spiral is avoided in this manner, and the compliance with preset heated zone measurements is facilitated. This contributes to the operational safety of the infrared radiator of the invention.

A pull tension is applied to the heating spiral during mounting. This is made possible by fixing the second end of the heating spiral via the connection body. The tension of the heating spiral can be preset so that length changes appearing during operation can be compensated for and, in this way, faulty operations of the heating spirals are avoided. The operational safety of the infrared radiator of the invention is also increased in this way. Due to the geometric affixing of the spiral, no recrystallization of the heating spiral material, usually tungsten, is necessary for the mounting of these infrared radiators. The installation of the heating spiral is considerably facilitated in this way.

The first heating spiral can also extend only over the first section of the first housing. In this case, the second heating spiral can be arranged in the first and/or second section of the second housing.

In a preferred embodiment of the infrared radiator of the invention, the connection body is a rigid metallic pin. The pin can, for example, be made of molybdenum. The pin usually extends transversely through both housings via the through bore of the inner bridge from the wall of the first housing up to the wall of the second housing. Since the twin tube is then closed off in the area of the connection body by means of a crimped area, the pin-shaped connection body and the unheated areas between two intermittently bordering radiators can be kept particularly short. The crimped area can then be provided directly on the pin. The pin can be inserted easily by means of a hole in the side wall of the twin tube. The hole in the side wall of the twin tube and the through bore can be produced in one operation. Since the pin is rigid, a change in length of the heating spiral is avoided.

It has been proven especially useful to shape one end of the heating spiral or a holding element connected to this end as an eyelet that mounts on the connection body. The connection body can be threaded easily into the opening of the eyelet during mounting. So-called support spirals, for example, can be used as holding elements for the heating spiral. The end of the support spiral facing the heating spiral has a somewhat smaller diameter than the heating spiral and extends partially into the same.

In an alternate preferred embodiment of the infrared radiator of the invention, one of the heating spirals or one holding element connected to this end is shaped in the form of a hook that grips onto the connection body. The hook can be easily connected to the connection body during mounting. The hook can be shaped also in the form of a half-shell that grips the connection element to achieve a safe electrical connection.

In an embodiment of the infrared radiator of the invention that has been particularly useful, the twin tube is subdivided along its length into two radiator sections, wherein at least one heating spiral is provided in one of the housings of each radiator section. The individual radiator sections can be heated separately from each other. The heating spirals of both radiator sections can instead be kept in series, and in this case the electrical connection of the heating spirals arranged in the different radiator sections can be carried out by means of individual connection bodies.

However, the inner bridge in each of the radiator sections can be advantageously provided with a through bore, while both through bores are arranged between the heating spirals. A conventional M-shaped connection part is no longer necessary for achieving the electrical connection of the heating spirals arranged in each radiator section. In this manner, mounting such that the individual radiator sections can be realized separately from each other is comparably simple. Both connection parts are inserted by means of holes in the side wall of the twin tube via through bores. These holes are later closed. Aside from this, the twin tube can be realized completely without seams.

In a further preferred embodiment of the infrared radiator of the invention, two heating spirals are arranged in each of the radiator sections.

With respect to the process, the tasks described above can be attained with the process referred to initially in that, on the second end of the heating spiral the cylinder jacket surface of the twin tube and the inner bridge are bored through. A connection body is inserted in the through bore and extends from one housing into the other. The connection body is electrically connected to the first heating spiral and to a connection wire or to the second heating spiral. The bore in the cylinder jacket surface of the twin tube is then closed.

The bore in the cylinder jacket surface of the twin tube is generated mainly radially from within, whereby the bore of the inner bridge is provided at the same time. The bore can, for example, be realized by boring, cutting, milling, grinding or melting. The connection body is introduced from outside through the bore. This facilitates the mounting of the heating spiral considerably. The known measures are not necessary for achieving the connection of the heating spiral and the connection body. The twin tube also shows no surrounding seam.

Since the connection body is inserted in the area of the second heating spiral ends, a return line like that of the conventional infrared radiator is not required. Each of the second ends of the heating spiral, or the heating spiral itself and the connection wire, are connected in such a manner that a firm electrical connection is generated.

The second end of the heating spiral is geometrically fixed by means of the connection to the connection body. A change in length of the heating spiral is avoided and compliance with preset heated zone measurements is facilitated. This contributes to the operational safety of the infrared radiator of the invention.

Furthermore, due to the geometrical fixing of the spiral, a recrystallization of the heating spiral material before mounting becomes superfluous. The roughening by crystallization of the heating spiral is thus avoided, whereby the installation of the heating spiral is further facilitated.

The fixing also allows for a pull tension to be applied to the heating spiral before mounting. The tension of the heating spiral can be preset so that length changes appearing during operation can be compensated for, and faulty operations of the heating spirals can be avoided. The operational safety of the infrared radiator of the invention is increased in this way.

The connection body is advantageously a rigid metallic pin. In a first preferred processing manner for connecting the pin and the heating spiral, the pin is guided into an eyelet connected to the heating spiral. As an alternative, it has been proven efficient to attach the pin onto a hook connected to the heating spiral. The connection body can also be welded to the eyelet or the hook for ensuring a firm mechanical and electrical connection. This can be carried out, for example with twin tubes of quartz glass, from the outside by means of suitable laser radiation. If the heating spiral is mounted under pull tension, this alone can create a sufficiently stable electrical connection, so that these measures are required only in very specific cases. The pull tension affords a sufficiently firm connection, particularly when using non-crystallized heating spirals that can shrink during their use due to crystallization.

It has been shown to be particularly advantageous to keep the heating spiral under pull tension when connecting the same to the connection body. This is true also for the first and second heating spiral if needed. In this way, a pull tension is applied to the heating spiral which can avoid faulty operations of the heating spiral during operation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
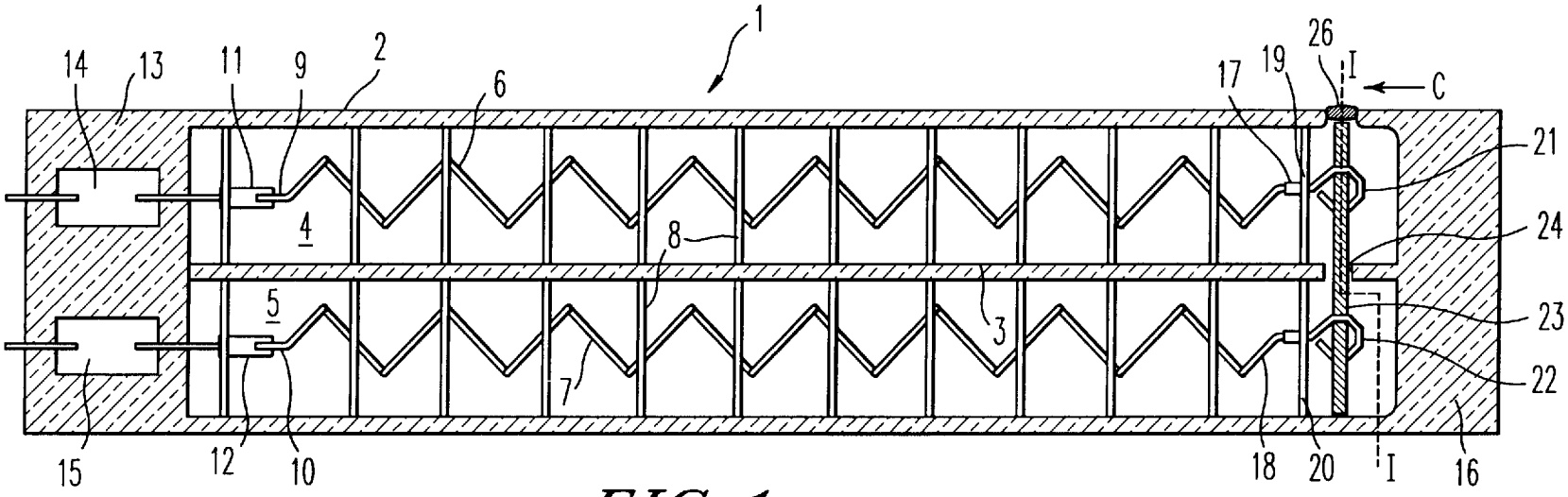
FIG. 1*a* is a first embodiment of a short-wave infrared radiator according to the invention viewed from above.

An infrared radiator is represented in FIG. 1, wherein two tube-shaped housings 4, 5 are formed within the twin tube 2 made of quartz glass and are separated by an inner bridge 3. A heating spiral 6, 7 made of tungsten wire, which is kept centered by means of support discs 8 within the housings 4, 5, is arranged in each of the housings 4, 5. The support discs 8 are distributed along the length of the heating spiral 6, 7 at even distances of approx. 15 mm.

The free first ends 9, 10 of the heating spirals 6, 7 are connected to the spiral supports 11, 12 which are respectively connected to sealed electrical current supplies 14, 15 via a crimp 13 at the radiator end. The opposite-lying end of the radiator 1 is also closed off by means of a crimp 16.

The heating spirals 6, 7 are electrically connected in series at their second ends 17, 18. Each electrical connection is carried out by means of support spirals 19, 20 that grip onto the second ends 17, 18 of the heating spirals 6, 7, and which are connected to a contact pin 23. The end of each support spiral 19, 20 mounts on the contact pin 23 via an eyelet 21, 22. The contact pin 23 passes through the eyelets and has a diameter of approx. 1.5 mm and a length of approx. 2.8 mm. The contact pin 23 has sufficiently high resistance to bending due to its thickness. It extends through the through bore 24 of the inner bridge 3, through both housings 4, 5 and through almost the complete width of the twin tube 1. The through bore 24 is positioned approx. 1 cm from the end of the heating spirals 6, 7.

The process for manufacturing the radiator of the invention is further explained below with reference to an exemplary embodiment.

Figure 1B:
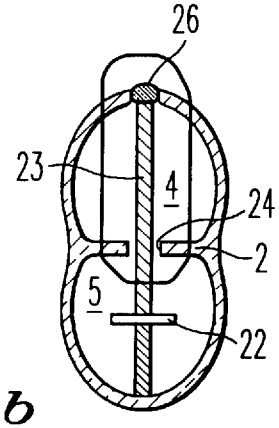
FIG. 1*b* is a section through the infrared radiator shown in FIG. 1 along line I—I viewed in the direction of arrow C.

A hole with a diameter of approximately 1.5 to 2 mm is bored into the side of the twin tube 2 (in FIGS. 1*a* and 1*b*, the hole is shown sealed with a quartz glass plug 26). The hole is bored in one operation through the wall of the twin tube 2 and the through bore 24. The bores in the exemplary embodiment were generated by means of an ultrasound bore. A milling of the inner bridge, as conventional, or a cutting of the twin tube for bringing in the contact pin, is avoided with this mounting process. Therefore, the twin tube 1 has no surrounding seam in the area of the through bore 24.

The heating spirals 6, 7 including the support spirals 19, 20 are inserted into the housings 4, 5. As soon as the eyelets 21, 22 are aligned with the hole (quartz glass plug 26) and the through bore 24, the contact pin 23 is threaded through the eyelets 21, 22 from the outside. Additionally, the heating spirals 6, 7 are prestressed by means of a tension arrangement, and the radiator 1 is closed off by means of the crimps 13 and 16.

The hole is then sealed by means of the quartz glass plug 26. No glass-blowing work is required otherwise on the twin tube. The mounting of the heating spirals 6, 7 is relatively easy. Since both ends 9, 10 or 17, 18 of the heating spirals 6 are fixed in place, there is no need for a recrystallization of the heating spirals 6, 7 before their mounting. Furthermore, installation of the heating spirals 6, 7 under mechanical prestressing is made possible.

The geometric arrangement of the contact pin 23 within the housings 4, 5 of the twin tube 2 can be seen in FIG. 1*b*. The housings 4, 5 have a somewhat elliptical cross-section. The contact pin 23 extends across both housings from one outer wall of the twin tube 2 to the opposite-lying outer wall, and is partially guided by the through bore 24. The hole in the outer wall of the twin tube 2 is closed off by the quartz glass plug 26. The eyelet-shaped end 22 mounts around the contact pin 23.

Figure 2:
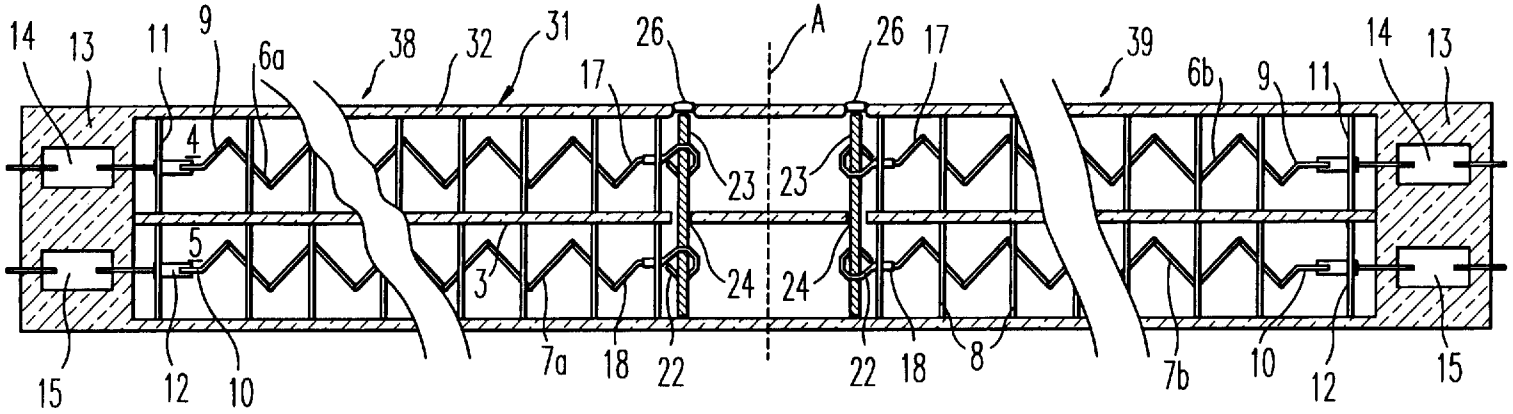
FIG. 2 is a further embodiment of a short-wave infrared radiator of the invention with two radiator sections viewed from above.
Figure 3:
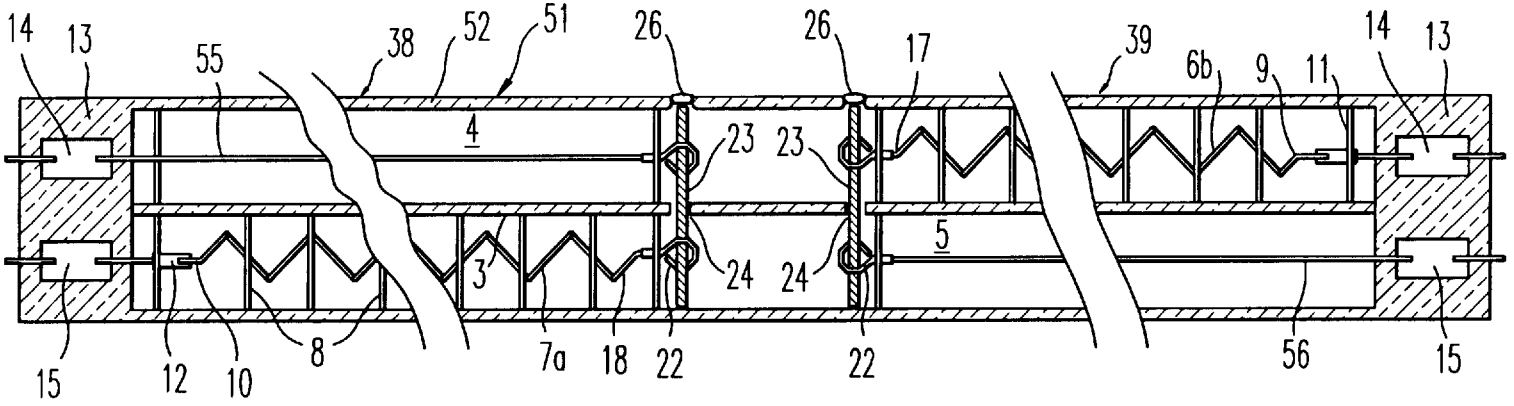
FIG. 3 is a further embodiment of a short-wave infrared radiator of the invention with two radiator sections viewed from above.

In FIGS. 2 and 3 the same reference numerals as in FIG. 1 are used for parts or component parts of the infrared radiator which are identical or equivalent to those parts or component parts that have already been explained in FIG. 1.

The short-wave infrared radiator 31 according to FIG. 2 is different from the infrared radiator 1 of FIG. 1*a* and FIG. 1*b* mainly in that it is divided along its length into two radiator sections 38, 39, wherein the heating spirals 6*a*, 7*a*, or 6*b*, 7*b* are electrically connected in series. The individual sections 38, 39, which can be electrically connected independently from each other and are substantially mirror-symmetric to each other, in which the mirror plane "A" runs transverse to the longitudinal axis of the radiator. The total length of the infrared radiator 31 is approx. 80 cm. It is shown broken off for facilitating an overview.

The infrared radiator 31 comprises a seamless twin tube 32 which is closed off at both ends by crimps 13, wherein the electrical current leads 14, 15 for the heating spirals 6*a*, 7*a* or 6*b*, 7*b* are soldered in. The twin tube 32 is separated into two housings 4, 5 by an inner bridge 3.

The heating spirals 6*a*, 7*a* or 6*b*, 7*b* are connected in series by pairs, by means of contact pins 23 spaced along the length of the infrared radiator 31 approximately in the middle of the same and between the heating spiral pairs 6*a*, 7*a* or 6*b*, 7*b* . The inner bridge 3 is provided with two through bores 24 that run parallel to each other and through each of which extends one of the contact pins 23. Each through bore 24 and contact pin 23 corresponds to those of the first embodiment.

The mounting of the short-wave infrared radiator shown schematically in FIG. 2 is particularly easily compared to the conventional one that also has two radiator sections. M-shaped contact handles such as the ones that have been used until now are not needed in the infrared radiator 31 according to the invention.

In the infrared radiator 31, each one of the heating spiral pairs 6*a*, 7*a* or 6*b*, 7*b* is brought in through the front sides of the twin tube 32 and are connected in pairs by means of the contact pin 23. The second ends of the heating spirals 6*a*, 7*a*, 6*b*, 7*b* are designated by the reference numerals 17, 18; the first ends connected to the electrical connection are designated by the reference numerals 9, 10. Both side openings of the twin tube 32 are closed off with glass plugs 26. Otherwise, the mounting of the infrared radiator 31 corresponds to that already described with respect to FIG. 1.

In the short-wave infrared radiator 51 shown in FIG. 3, the twin tube 52 that corresponds to the embodiment shown in FIG. 2 is also divided into two radiator sections 38, 39, as well as into two tube-shaped housings 4, 5 with elliptical cross-sections, by the inner bridge 3. This embodiment is different from the infrared radiator 31 shown in FIG. 2 in that a single heating spiral 6*b*, 7*a* is provided in each of the two housings 4, 5, and both heating spirals 6*b*, 7*a* lie opposite each other in the radiator sections 38, 39. Instead of being connected to a second heating spiral as in FIG. 2, in this embodiment each heating spiral 6*b* or 7*a* is electrically connected to a connection wire 55 or 56 in the other housing. Otherwise, this embodiment corresponds to that of FIG. 2 with reference to the electrical connection 22, 23, 24, 25 and the mounting of the infrared radiator 51.

Figure 4:
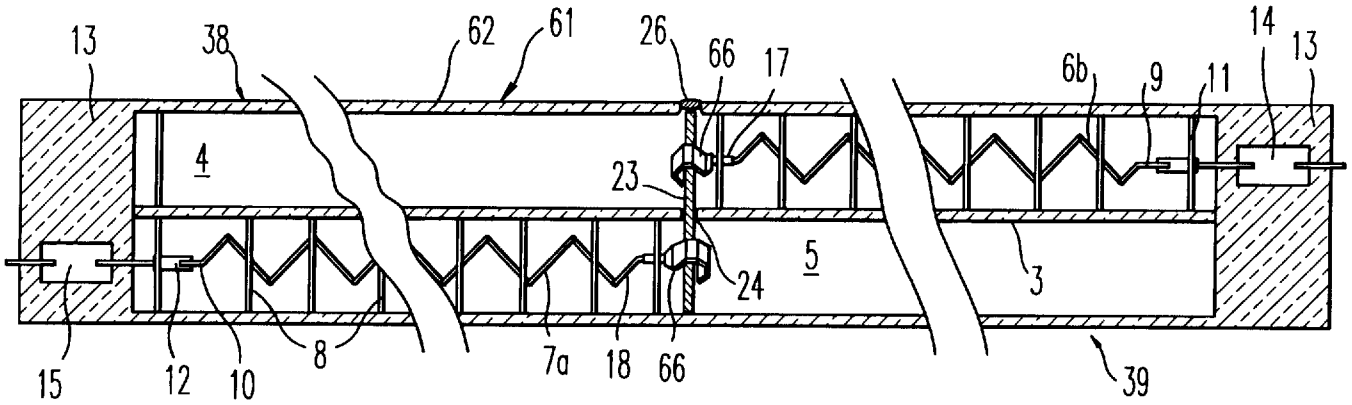
FIG. 4 is a further embodiment of a short-wave infrared radiator of the invention with two radiator sections viewed from above.

In the short-wave infrared radiator 61 according to FIG. 4, the twin tube 62, which corresponds to that of FIG. 2, is also divided into two radiator sections 38, 39, as well as by an inner bridge 3 into two tube-shaped housings 4, 5 with elliptical cross-sections. Again, like the embodiment of FIG. 3, only one spiral heater 6*b*, 7*a* is provided in each of the two housings 4, 5, wherein one of the heating spirals 6*b*, 7*a* lies in each of the radiator sections 38 or 39.

The embodiment shown in FIG. 4 is different from the infrared radiator 31 shown in FIG. 3 primarily in that both heating spirals 6*b*, 7*a* are electrically connected to one another by means of a contact pin 23 arranged therebetween.

During mounting of the infrared radiator 61, one of the heating spirals 6*b* or 7*a* is guided into one of the housings 4, 5 from the open front of the twin tube 62, and is electrically and mechanically connected to the contact pin 23. For this connection, the second ends 17 or 18 of the heating spirals 6*b* or 7*a* facing the contact pin 23 are connected to half-shell shaped hooks 66 that partially enclose the contact pin 23. The contact pin 23 extends across both housings 4, 5 of the infrared radiator 61 through a bore 24 of the inner bridge 3. The insertion of the contact pin 23, as well as the mounting of the infrared radiator 61, are otherwise carried out in a manner corresponding to that of the previous embodiments.

Obviously, numerous modifications and variations of the present invention are possible in light of the above teachings. It is therefore to be understood that the invention may be practiced otherwise than as specifically described herein.

What is claimed is:

1. A process for the manufacture of an infrared radiator, comprising the steps of:

preparing a twin tube having an inner bridge separating two housings which run in a longitudinal direction along the tube;

installing a first heating spiral in a first of the housings;

installing one of a connection wire and a second heating spiral in a second of the housings;

connecting a first end of the first heating spiral to an external current supply;

forming a bore in a second end of the twin tube and the inner bridge;

electrically connecting a second end of the first heating spiral to the one of the connection wire and the second heating spiral arranged in the second housing by inserting a connection body into the bore and through said inner bridge and electrically connecting the connection body to the first heating spiral and the one of the connecting wire and the second heating spiral in the second housing; and closing off the bore.

2. Process according to claim 1, wherein the connection body comprises a rigid metallic pin.

3. Process according to claim 2, wherein the electrically connecting step comprises mounting an eyelet which is connected to the heating spiral onto the pin.

4. Process according to claim 2, wherein the electrically connecting step comprises mounting a hook which is connected to the heating spiral onto the pin.

5. Process according to claims 1 to 4, including the step of applying pull tension to the first heating spiral installed in the first housing.

* * * * *